US009243771B2

(12) United States Patent
Jungwirth et al.

(10) Patent No.: US 9,243,771 B2
(45) Date of Patent: Jan. 26, 2016

(54) LED LIGHT-SOURCE MODULE FOR AN LED MOTOR VEHICLE HEADLIGHT

(75) Inventors: Johannes Jungwirth, Wolfsbach (AT); Andreas Moser, Haag (AT); Günther Krenn, Boheimkirchen (AT)

(73) Assignee: ZIZALA LICHTSYSTEME GMBH, Wieselburg (AT)

( * ) Notice: Subject to any disclaimer, the term of this patent is extended or adjusted under 35 U.S.C. 154(b) by 139 days.

(21) Appl. No.: 14/237,710

(22) PCT Filed: Jul. 16, 2012

(86) PCT No.: PCT/AT2012/050106

§ 371 (c)(1),
(2), (4) Date: Feb. 21, 2014

(87) PCT Pub. No.: WO2013/020156

PCT Pub. Date: Feb. 14, 2013

(65) Prior Publication Data

US 2014/0204602 A1 Jul. 24, 2014

(30) Foreign Application Priority Data

Aug. 8, 2011 (AT) ..... A 1140/2011

(51) Int. Cl.
*F21V 5/00* (2015.01)
*F21S 8/10* (2006.01)

(52) U.S. Cl.
CPC ..... *F21S 48/125* (2013.01); *F21S 48/115* (2013.01); *F21S 48/1154* (2013.01); *F21S 48/1241* (2013.01); *F21S 48/1266* (2013.01); *F21S 48/1275* (2013.01); *F21S 48/145* (2013.01)

(58) Field of Classification Search
CPC ..... F21S 48/1763; F21S 48/1784
See application file for complete search history.

(56) References Cited

U.S. PATENT DOCUMENTS 5,685,627 A * 11/1997 Kato ..... 362/551
2005/0225999 A1* 10/2005 Bucher ..... 362/539

(Continued)

FOREIGN PATENT DOCUMENTS

DE 202007018181 U1 5/2008
DE 102011077636 A1 * 11/2011

(Continued)

OTHER PUBLICATIONS

First Office Action of May 21, 2012 of corresponding Austrian priority patent application A1140/2011.

(Continued)

*Primary Examiner* — Peggy Neils
*Assistant Examiner* — Alexander Garlen
(74) *Attorney, Agent, or Firm* — Sutherland Asbill & Brennan LLP

(57) ABSTRACT

An LED light source module for an LED motor vehicle headlight is disclosed. The module comprises at least one LED light source composed of at least one light-emitting diode, which couples light into an associated primary lens wherein the in-coupled light at least partially exits a light exit area of the primary lens. The module also comprises a secondary lens, which images the light exiting the exit area—when the headlight is installed in a vehicle—as a light pattern onto a region located in front of the vehicle. A diaphragm assembly is provided between the light exit area and the secondary lens. The diaphragm assembly comprising at least one optically effective diaphragm edge, which is arranged and/or extends such that undesired distortions occurring in an upper and/or lower region of the light pattern are at least partially suppressed in the light pattern.

52 Claims, 6 Drawing Sheets

(56) References Cited

U.S. PATENT DOCUMENTS

| | | | | |
|---|---|---|---|---|
| 2010/0085769 | A1* | 4/2010 | Tatsukawa | 362/539 |
| 2010/0226144 | A1 | 9/2010 | Stade et al. | |

FOREIGN PATENT DOCUMENTS

| | | | |
|---|---|---|---|
| EP | 0689002 | A2 | 12/1995 |
| EP | 0721085 | A1 | 7/1996 |
| EP | 2280215 | A2 | 2/2011 |
| EP | 2306074 | A2 * | 4/2011 |
| GB | 2149077 | A | 6/1985 |
| WO | 2009/130655 | A2 | 10/2009 |

OTHER PUBLICATIONS

Search Report of Oct. 16, 2012 of corresponding international patent application PCT/AT2012/050106.

* cited by examiner

LED LIGHT-SOURCE MODULE FOR AN LED MOTOR VEHICLE HEADLIGHT

The invention relates to an LED light source module for an LED motor vehicle headlight, in particular for an LED motor vehicle headlight for generating a dynamic light distribution, wherein the LED light source module comprises at least one LED light source, wherein the at least one LED light source is composed of at least one light-emitting diode, and wherein the at least one light-emitting diode of the at least one LED light source couples light into an associated primary lens element, wherein the in-coupled light at least partially exits a light exit area of the primary lens element again, and wherein the LED light source module comprises a secondary lens, which images the light exiting the at least one light exit area of the at least one primary lens element—when the headlight is installed in the vehicle—as a light pattern onto a region located in front of the vehicle.

The invention further relates to a headlight comprising such an LED light source module and to a corresponding headlight system.

In motor vehicle construction, light-emitting diodes are used with increasing frequency to implement headlight functions such as for generating low-beam light and/or high-beam light, but also additional light functions, such as highway light, poor weather light and daytime running lights.

In addition, headlight LED light sources are also particularly well-suited for special applications, for example for object illumination, where only certain LED light sources are visible or emit light, while the remaining LED light sources do not emit light. In the case of object illumination, for example, objects on the side of the road, such as pedestrians, but also traffic signs, are irradiated with light, for example with infrared light, and these objects can then be recorded with an infrared camera. It is also possible, of course, to use visible light, such as for traffic sign illumination.

Conversely, it can also be possible, of course, to hide exactly those regions of the light distribution which would result in glare for the oncoming traffic from a light distribution, such as a high-beam light distribution when oncoming traffic occurs, so that no glare occurs.

The above objects can be implemented by selectively activating, or in the latter case by selectively deactivating, certain LED light sources.

At present, electronic solutions are available for selecting certain LED light sources, in which only certain LED light sources are activated or deactivated, so that only the desired LED light sources emit light onto the road. This solution offers high flexibility because basically any arbitrary LED light sources are activated.

Other solutions show diaphragms, which can be brought into an appropriate position for screening off the light of certain LED light sources.

A headlight having the above-mentioned LED light source modules is known from the Austrian application AT 508604 by the applicant, which can be used to generate a dynamic light distribution, which can be adapted to different traffic situation etc. during driving operation.

Such a headlight can be implemented in particular with conventionally available LED light sources.

Using static lighting technology, such a headlight can be used to implement individual light functions, such as low-beam light, high-beam light, cornering light and the like without moving parts by dividing the illuminated area into separately switchable segments. The light originating from the LEDs is projected by way of the individual primary lens elements, which form the individual segments of the light exit area, and the associated secondary lenses onto the roadway in the form of segmented light distribution.

However, as the distance between the illuminated segments of the primary lenses from the optical axis of the associated secondary lens increases, the distortion error of the secondary lenses (projection lens) becomes a problem, so that an aberration of the light pattern occurs in an outer region of the light pattern, which is formed by the segment or segments or the primary lens elements located the farthest away from the optical axis, in particular a cushion-shaped distortion, wherein this is located primarily above the bright/dark boundary.

While an optical correction of the secondary lenses can technically be implemented, it is not economically expedient.

It is an object of the invention to solve the above-described problem in an economically expedient manner.

This object is achieved by an above-described LED light source module in that, according to the invention, a diaphragm assembly is provided between the at least one light exit area of the at least one primary lens element and the secondary lens, the diaphragm assembly comprising at least one optically effective diaphragm edge, which is arranged such and/or extends such that undesirable distortions occurring in an upper and/or lower region of the light pattern are at least partially suppressed in the light pattern.

By using a diaphragm assembly, distortions that occur at the edge of the light pattern anyhow can be suppressed in a simple and cost-effective manner, without adversely affecting the remaining light pattern.

The above-described problem occurs in particular when, as discussed above, the LED light source module comprises two or more LED light sources, wherein an LED light source is composed in each case of at least one light-emitting diode, and wherein the respective light-emitting diodes of each LED light source couple light into a primary lens element associated with the light source, wherein the in-coupled light at least partially exits the light exit area of the primary lens element again, and wherein the secondary lens images the light segments generated by the light exit areas of the primary lens elements—when the headlight is installed in the vehicle—a region located in front of the vehicle.

By using a diaphragm assembly, the problems that occur can be optimally eliminated in particular in such an assembly.

All primary lens elements associated with a secondary lens form what is referred to as the "primary lens", the primary lens elements are preferably joined to each other, and generally even are designed as one piece. This primary lens has a total light exit area, formed by the individual light exit segments of the primary lens elements.

In one specific variant of the invention, it is provided that the total light exit area formed by the light area or areas of one or the multiple primary lens elements has a defined height and width, for example in form of a rectangle, and wherein the focal point of the secondary lens element is located in a lateral border region of the total light exit area, and wherein the at least one edge has a course/contour in which the edge edge has a larger normal distance from the focal point than from a horizontal plane through the focal point of the secondary lens element in the border region of the total light exit area which is located opposite the focal area.

In the border located further away from the focal point, the diaphragm edge thus has a smaller (normal) distance than in the region of the focal point (which is located in the other border region); for different modules, the focal point may be located at different sites, but always in a border region.

The focal point of the secondary lens is located in the plane of the light exit area of the primary lens elements, or of the primary lens, where the optical axis of the secondary lens "penetrates" the plane.

It is useful if the normal distance of the diaphragm edge to the focal point of the secondary lens element represents the largest distance of the diaphragm edge to the horizontal plane, and if the normal distance to the horizontal plane decreases border region decreases toward the border region which is located further away from the focal point.

The measures described above ensure that light is accordingly blocked in the regions from which the distortions stem, while light from the regions having lower or no distortion is blocked little or not all in the light pattern.

In particular, it is advantageous if the normal distance of the diaphragm edge to the focal point of the secondary lens element constitutes the largest distance of the diaphragm edge to the horizontal plane, and that the normal distance to the horizontal plane remains the same as the normal distance of the diaphragm edge to the focal point, preferably beyond the border region that includes the focal point.

So as to be able to block distortions in the light pattern both above and outside the bright/dark boundary, it is further advantageously provided that the diaphragm assembly has two optically effective diaphragm edges, these being an upper diaphragm edge and a lower diaphragm edge, wherein the upper diaphragm edge runs above a horizontal plane through the optical axis of the secondary lens, and the lower edge runs below this plane.

The diaphragm assembly is composed of one diaphragm or two diaphragms, which has or have at least one optically effective diaphragm edge, wherein preferably only one diaphragm part, which is to say exactly one diaphragm, having one or two diaphragm edges, is provided.

A compact and stable assembly is achieved if the diaphragm assembly, for example the one diaphragm or the two diaphragms, is designed as one piece with a holder for the primary lens or is attached to this holder.

It may also be provided that the diaphragm assembly, for example the one diaphragm or the two diaphragms, are formed of a material that is at least partially optically transparent, wherein the diaphragm assembly or the at least one diaphragm is coated with the semitransparent material, for example.

In this case, the diaphragm assembly or the at least one diaphragm is not designed to have a fully, which is to say 100%, light blocking effect, but allows a portion of the light to pass. In this way, softer peripheries in the light distribution, primarily at the bright/dark boundary, can be achieved.

For example, the surface of a diaphragm formed of a transparent material is coated with metal, for example, for this purpose. Depending on the thickness of the layer, this layer essentially allows light to pass through, which is to say partially translucent. For example, this coating can be configured so as to be completely translucent in the region of the diaphragm edge, and so as to become increasingly less translucent as the distance from the diaphragm edge increases.

In one embodiment, which is easy to implement, requires little space and optically supplies very good results, it is provided that the at least one diaphragm has a planar design, or that the at least one diaphragm edge is located in a vertical plane, which preferably runs parallel to the total light exit area of the primary lens elements.

The at least one diaphragm has a planar design and is situated normal to the light exit direction in the beam path.

Even slightly better optical results can generally be achieved if the at least one diaphragm or the at least one diaphragm edge is curved in the horizontal direction, wherein the curvature preferably corresponds essentially to the field of curvature of the secondary lens element or follows this field of curvature.

The curvature of the at least one diaphragm edge (in a horizontal plane) follows the field of curvature of the secondary lens, or the diaphragm (at least a diaphragm edge) is curved away from the light exit area of the primary lens element.

However, this variant is more complex to produce and requires more space.

In addition, it is advantageously provided that the diaphragm edge or the projection of the at least one diaphragm edge into a vertical plane has a curved course.

A diaphragm edge is thus composed of one or more curved curve sections in a projection into the vertical plane.

However, it may also be provided that the diaphragm edge, or the projection of the at least one diaphragm edge into a vertical plane, is composed of one or more rectilinear sections.

It may be provided that the transition between two rectilinear sections, or between two curved curve sections, is discontinuous, for example occurs in form of an edge.

Likewise, it can be provided that the diaphragm edge or the projection of the at least one diaphragm edge has a continuous or a discontinuous course.

It has been found that optimal results are typically achieved when the diaphragm is positioned at a small distance in front of the primary lens, for example in one specific variant between approximately 10 mm and 20 mm away from the primary lens. If it is necessary to arrange the diaphragm directly on the primary lens (which is to say on the light exit area thereof) due to the installation space, interfering serrations occur in the light distribution. These serrations in the light pattern can be minimized with a discontinuous, "serrated" diaphragm edge(s).

It is further provided that, when exactly two diaphragm edges are present, the upper edge has a smaller normal distance, preferably along the entire horizontal extension, to a horizontal plane through the focal point of the secondary lens element than the lower edge.

In this way, high-beam light or partial high-beam light can be optimally generated, for example. The position of the plane EH in general depends on what light distribution is to be generated, and as a result, the invention is not limited to the plane EH being located above the plane of symmetry.

The light exit area of a primary lens is usually designed symmetrically in the vertical and horizontal directions. The upper and lower diaphragm edges have an approximately identical distance to a horizontal plane which cuts this light exit area in half (in the same position along the plane in the horizontal direction), and in some variants, the upper and lower edges are even mirrored about this plane, which is to say they have identical distances.

So as to generate a desired light pattern, the horizontal plane through the focal point of the secondary lens is located above this plane of symmetry, which is why the different distances of the two diaphragm edges to the horizontal plane through the focal point of the secondary lens occur.

The light pattern is trimmed accordingly less in the lower region than in the upper region (the lower region results from the projection of the upper region of the light exit area by way of the secondary lens and vice versa).

In principle, it applies that the upper and lower edges can have any arbitrary shape, in particularly any arbitrarily mutually deviating shapes, with respect to the particular course, which is to say, any symmetries between the upper and lower edges are not absolutely necessary.

However, it may be advantageous if it is provided in the case of exactly two diaphragm edges that the upper edge and the lower edge have courses that are mirrored with respect to a horizontal plane of symmetry.

This means that the upper edge mirrored about the plane of symmetry yields the lower edge.

The horizontal plane through the focal point of the secondary lens is located above this horizontal plane of symmetry through which the total light exit area extends (see above).

As a result of the segmentation of the total light exit area, inhomogeneities occur in the light distribution, in particular in the forward field, such as fraying, streaking or spotting, which has an interfering effect in the projection onto the ground/the roadway. So as to prevent these or reduce these effects, it may be provided that the light exit areas of the primary lens elements of an LED light source module are joined to each other by way of a translucent material in such a way that light that is coupled into the primary lens elements can enter the translucent material and exit the same again via a light exit area of the translucent material.

By joining the individual primary lens elements, the light exit areas of which form the segments in the light pattern, by way of a translucent material, it is achieved that the inhomogeneities in the light pattern wash out with each other in the light pattern as a result of streaking, so that the interfering effects in the light pattern are mitigated or entirely eliminated.

In one specific variant of the invention, it is provided that the light exit areas of the primary lens elements are located in a common area, and that the light exit area of the translucent material is likewise located in the common area of the light exit areas of the primary lens elements.

This common area is either designed as a plane or curved in keeping with the field of curvature of the secondary lenses.

A portion of the light entering a primary lens element is now no longer emitted via the light exit area of the primary lens element itself, but enters the translucent material and exits via the light exit area thereof. As a result, a portion of the light entering the primary lens elements is mixed in and reduces or eliminates the inhomogeneities in the light pattern. The light exiting the translucent material thus contributes to the light distribution.

It has been found to be particularly advantageous for reducing/eliminating the inhomogeneities if the light exit areas of the primary lens elements are joined to each other in an upper and/or in a lower region.

In any case, the primary lens elements are preferably joined to each other in the upper region. The terms "upper" and "lower" here refer to the module/headlight when installed in the vehicle.

This upper region is imaged by way of the secondary lens in the light pattern below the bright/dark boundary, where the undesired inhomogeneities occur primarily or the strongest.

Joining in the lower region is of less importance from an optical point of view and has advantages in particular from a mechanical point of view, in order to increase the stability of the entire element, formed of the individual primary lens elements.

In one specific variant of an LED light source module, it is provided that at least one essentially horizontal joining rib, which is formed of the translucent material, is provided, which joins the primary lens elements to each other in the upper and/or lower regions of the light exit areas thereof.

In particular exactly two essentially horizontal joining ribs which are formed of the translucent material are provided, which join the primary lens elements to each other in the upper and lower regions of the light exit areas thereof, wherein the upper rib is of importance from an optical point of view and from a mechanical point of view, while the lower rib is of importance primarily from a mechanical point of view.

The at least one joining rib is preferably designed as one piece with the light exit areas of the primary lens elements or with the primary lens elements, which is to say the individual primary lens elements and the joining rib or fibs form a single element, referred to as the primary lens.

Regardless of whether or not the ribs and primary lens elements are joined as one piece with each other, it is advantageous if the light exit areas of the primary lens elements and those of the at least one joining rib form a common light exit area, which is to say that they are located in a common plane and preferably are joined to each other also without interruption, which is to say without a gap or the like.

So as to achieve optimal optical effects, it is provided that the at least one joining rib extends in the vertical direction upward/downward over a certain defined height beyond the light exit areas of the primary lens elements.

It is also within the above meaning if the at least one joining rib extends in the horizontal direction laterally over a certain length beyond the light exit areas of the primary lenses.

It is further expedient if the at least one joining rib extends in the horizontal direction toward the back in the direction of the light sources and is joined to the primary lenses over a certain extension.

The design of the joining rib or ribs, in particular the extension of the joining rib(s) toward the back affects the homogeneity of the light pattern, which is also accompanied by a reduction in the maximum of the light distribution, which is to say, the more homogeneously the light pattern is selected, the more strongly will the maximum be reduced.

Depending on the desired effects, it is therefore provided that the extension of the at least one joining rib toward the bottom/top and/or the extension of the at least one joining rib laterally beyond the light exit areas of the primary lens elements and/or the extension of the at least one joining rib in the horizontal direction toward the back, in particular the extension across which the at least one joining rib is joined to the primary lens elements, is/are selected such that the desired degree regarding the homogeneity of the light pattern and the desired degree of the reduction of the maximum in the light distribution are achieved.

Multiple LED light source modules are employed in a headlight, as will be described hereafter. In principle it is provided that these, to the extent this is possible, have an identical design, in particular also that these comprise identical primary lens elements or primary lenses (=primary lens elements joined by one or two ribs). However for optical reasons, in principle it may also be provided that the modules, in particular the primary lenses, and here in particular the design of the at least one joining rib, differ from each other, so that an optimal adaptation of the desired light pattern can take place.

Light from the LEDs propagates in the primary lens elements as a consequent of total reflection. To ensure that a sufficient amount of light can penetrate into the translucent regions, which is to say the joining rib or ribs, it is favorable, as described above, if these are joined over a certain extension to the primary lenses—within the meaning of contacting each other, preferably being joined to each other, in particular as one piece.

Optically it may also be favorable if the at least one, in particular the upper, joining rib is designed to taper, for example in a wedge shape, in the direction of the light in-coupling points of the primary lens elements.

This embodiment offers considerable improvements from an optical point of view compared to a cuboid, which is to say non-tapering, embodiment of the joining rib. This applies in particular the further the joining rib extends toward the back. In addition, material can be saved due to the wedge shape, which results in a cost reduction.

It may be favorable in particular if the primary lens elements widen from the light in-coupling points toward the light exit areas, wherein the primary lens elements widen more strongly toward the bottom than toward the top.

The primary lens elements, for example, have a wedge shape, wherein the element expands more strongly toward the bottom.

In principle, relatively arbitrary shapes may be used for the light exit areas of the primary lens elements. It has been found to be favorable when the light exit areas of the primary lens elements are rectangular. Corresponding primary lenses are also easy to produce and exhibit good optical properties in regard to the superimposition of the segments of the light distribution generated by the primary lenses over the secondary lenses. Such light exit areas can additionally be used to generate a homogeneous light distribution without gaps in the light pattern over the entire height of the light distribution in the horizontal direction.

For the majority of applications it is sufficient if all light exit areas have an identical shape. This has the advantage of simple calculation and production of the headlight and considerably lowers the costs of the headlight.

However, it may also be provided that light exit areas having differing shapes, for example having differing widths (horizontal extension) are used. For example, certain regions of the light distribution can be generated by way of narrower light exit areas, whereby a finer segmentation of the light pattern is achieved there, and smaller or narrower regions can be suppressed.

Moreover, it is favorable if the light exit areas of the primary lens elements are arranged parallel to each other and in identical orientation.

As a result of the parallel and identical orientation, a light pattern that is compliant with the law can be generated in a simple manner, even in the vertical direction.

It is particularly advantageous when the light exit areas of the primary lens elements of an LED light source module are arranged next to each other at a horizontal distance.

Not only can such an arrangement be achieved in practice without major difficulty, the light exit areas thus also image sharply delimited segments in the light pattern by way of the secondary lens, the superimposition of which then results in the entire light pattern. By switching off one or more LED light sources, defined regions in the light pattern can be optimally suppressed in such an arrangement.

As was already addressed above, each LED light source module is associated with a secondary lens, which images the light segments generated by the light exit areas of the primary lens elements—when the headlight is installed in the vehicle—onto a region located in front of the vehicle.

By arranging the LED light sources according to the invention in two or more LED light source modules, a homogeneous light distribution, for example a high-beam light distribution, can be generated by appropriately horizontally arranging the individual light segments next to each other and/or superimposing them, and out of this light distribution, very specific regions of the light distribution can be "suppressed", which is to say not illuminated, by shutting of individual or multiple LED light sources, for example so as to prevent glare for the oncoming traffic.

For example, the individual light segments can be arranged directly abutting each other in the horizontal direction. So as to ensure that the transitions are not excessively abrupt or edges are visible in the light distribution, additionally one or more other light segments can be superimposed in such regions of mutually abutting light segments. This also has the advantage that, as will be described in more detail hereafter, by suppressing, for example, two light segments, regions that are narrower than one light segment can be "suppressed" from the light distribution, or not illuminated.

In one specific form, the light exit areas are designed standing in the vertical direction, having a larger height than width, for example in the form of rectangles or ellipses.

As a result of this standing shape having a larger height and lower width, a light exit area illuminates a narrow angular range in the horizontal direction, and vertically the entire region for this horizontal angular region can be illuminated by this one light exit area.

It is particularly advantageous if neighboring light exit areas of the primary lens elements of an LED light source module have a normal distance to each other which corresponds to the width of a light exit area, and if preferably a first total arrangement of the light exit areas assumes a first defined position in relation to the optical axis of the secondary lens, and wherein a second/third/fourth . . . n-th total arrangement is displaced in relation to the optical axis of the secondary lens as compared to the first total arrangement by half/once/twice/quadruple/((n−1)/2) times the normal distance between two neighboring light exit areas of an LED light source module.

This results in an arrangement in which—apart from the horizontal border regions—a sharp region, which corresponds to half the width of a light exit area, can be suppressed by suppressing two light sources of the entire headlight.

In one specific tested embodiment of the invention, the distances between light exit areas of neighboring primary lens elements are identical in the case of three or more primary lens elements, and preferably all the distances between the light exit areas of neighboring LED light sources over the entire headlight are identical.

This results in a simple design having identical modules, by way of which a homogeneous light distribution can be achieved.

An LED motor vehicle headlight according to the invention for generating a dynamic light distribution comprises two or more LED light source modules as described above, wherein preferably the secondary lens elements of the LED light source modules and the arrangement of the light exit areas of the primary lens elements are matched to each other in such a way that the light segments from the individual LED light source modules are imaged offset from each other in the horizontal direction, and wherein the individual LED light sources can be operated separately.

It is particularly advantageous in such a headlight if the course of the at least one diaphragm edge is identical in all LED light source modules, in particular that, in the case of two diaphragm edges per LED light source module, the upper diaphragm edges have an identical course and/or the lower diaphragm edges have an identical course.

This offers major advantages, in particular with respect to simple manufacturing of the diaphragms, the assembly of the modules and stock keeping.

In one specific version, it is provided that the respective at least one diaphragm edge is arranged differently in relation to the total light exit areas in the different LED light source modules.

It is provided in one variant that the LED light source modules are arranged in a horizontal row.

In this way, the individual segments of the primary lenses can be imaged next to each other and in an overlapping manner, so as to form the desired light distribution in front of the vehicle.

In addition, it is provided that the focal points of the secondary lens elements of the LED light source modules are located in a common vertical plane, which is spanned by the total light exit areas of the primary lenses of the LED light source modules, and in a common horizontal plane.

Finally, it is also provided that the focal points of the secondary lenses of the individual LED light source modules are arranged mutually offset from each other laterally, which is to say in the horizontal direction—in relation to the respective total light exit area of the primary lenses.

Specifically, it is provided that the focal points of the secondary lens elements are located in a lateral border region of the total light exit area of the respective associated primary lens, wherein, in a first outer LED light source module, the focal point is located closest to the border of the total light exit area, and the focal point moves away from the border upon progressing in the direction of the second outer LED light source module.

The focal points thus move away from the one border, but only far enough for them to continue to remain in the "border region." This means that the two outer focal points are located away from each approximately in the range of the width of a segment, which is to say the width of the light exit area of a primary lens element.

Advantageously, it is also provided that the focal point comes closest to the border of the total light exit area of the primary lens in the vehicle-internal LED light source module, and the focal point is located the farthest from the border of the total light exit area of the associated primary lens in the vehicle-external LED light source module.

It is within the meaning of a simple, cost-effective design of the headlight if the individual LED light source modules comprise identical secondary lens elements.

Preferably all the distances between light exit areas of neighboring LED light sources over the entire headlight are identical, whereby a simple design having identical modules is obtained, by way of which a light distribution can be achieved which in general is as homogeneous as possible.

At this point it shall be briefly mentioned that "homogeneous" shall not be understood to mean that the light pattern is uniformly bright everywhere across the illuminated region, but that the transitions in the light pattern between regions of varying brightness are continuous, and that no sharp transitions occur. The total light pattern should not be "spotty", but have flowing transitions from brighter to darker regions.

The light pattern can be additionally improved by the present invention.

Specifically, it is further provided that the total arrangement of the light exit areas of an LED light source module in relation to the optical axis of the secondary lens element assumes a defined position in the horizontal direction, wherein the different total arrangements of the individual LED light source modules have defined positions that differ from each other in the horizontal direction in relation to the optical axis of the respective associated secondary lens element.

It may be provided that the light exit areas of all LED light source modules of the headlight in each case are arranged on one side of a vertical plane through the optical axis of the respective associated secondary lens.

Moreover, it may be provided that exactly one light exit area of all light exit areas of a headlight intersects the optical axis of the secondary lens associated therewith.

It is provided to this end that an LED light source comprises at least two light-emitting diodes which are arranged horizontally on top of each other and which can be operated independently of each other, wherein each of the at least two light-emitting diodes are imaged via the light exit area of the primary lens element as horizontal light segments—within the vertical light segment imaged by the primary lens elements.

Each light-emitting diode of an LED light source can preferably be operated separately.

In a vehicle headlight system according to the invention, comprising two headlights as described above, in which the left headlight, when installed in the vehicle, generates the left portion of the light distribution on the roadway and the right headlight generates the right portion of the light distribution, it is provided that preferably at least each LED light source, preferably each light-emitting diode of the two headlights, can be separately operated.

In particular it is provided that the left and right headlights have a laterally reversed design with respect to the arrangement of the focal points of the secondary lenses in relation to the associated primary lenses and with respect to the courses of the diaphragm edges.

The invention will be described in more detail hereafter based on the drawings. In the drawings.

Figure 1:
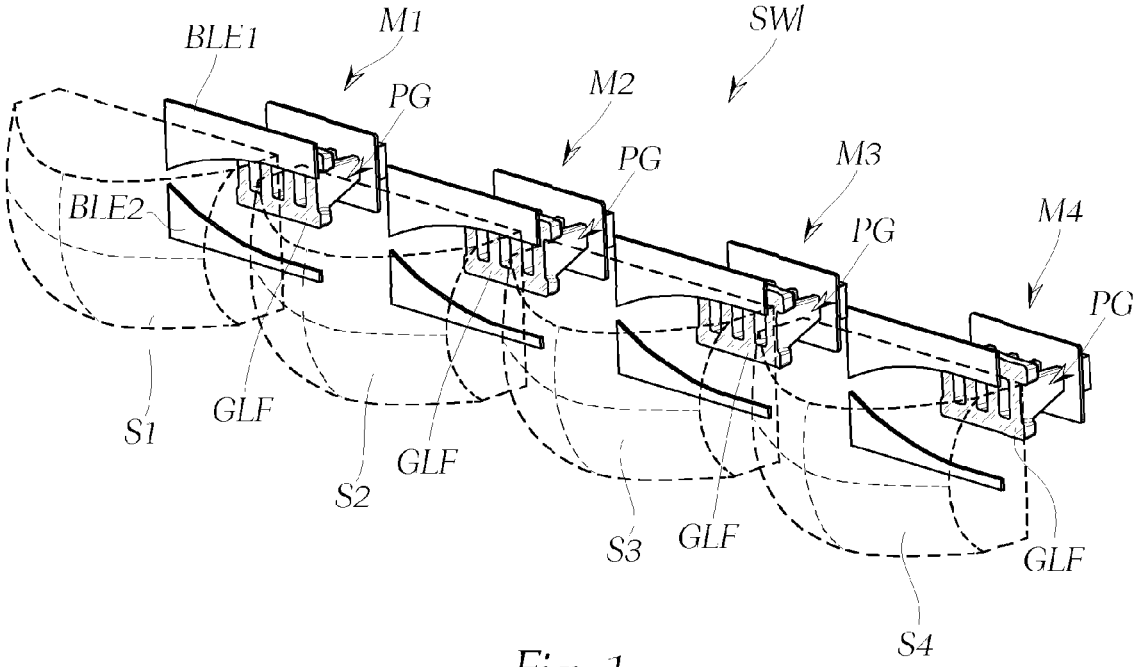
FIG. 1 shows a perspective view of a headlight comprising multiple (four) LED light source modules for generating a light pattern.

FIG. 1 shows an LED motor vehicle headlight SWl for generating a dynamic light distribution, here a left headlight, comprising four LED light source modules M1 to M4 arranged in a row. Each LED light source module M1 to M4 comprises a secondary lens S1, S2, S3, S4, which images the light exiting the total light exit area GLF of a primary lens PG—when the headlight SWl is installed in a vehicle—as a light pattern onto a region located in front of the vehicle.

Figure 2:
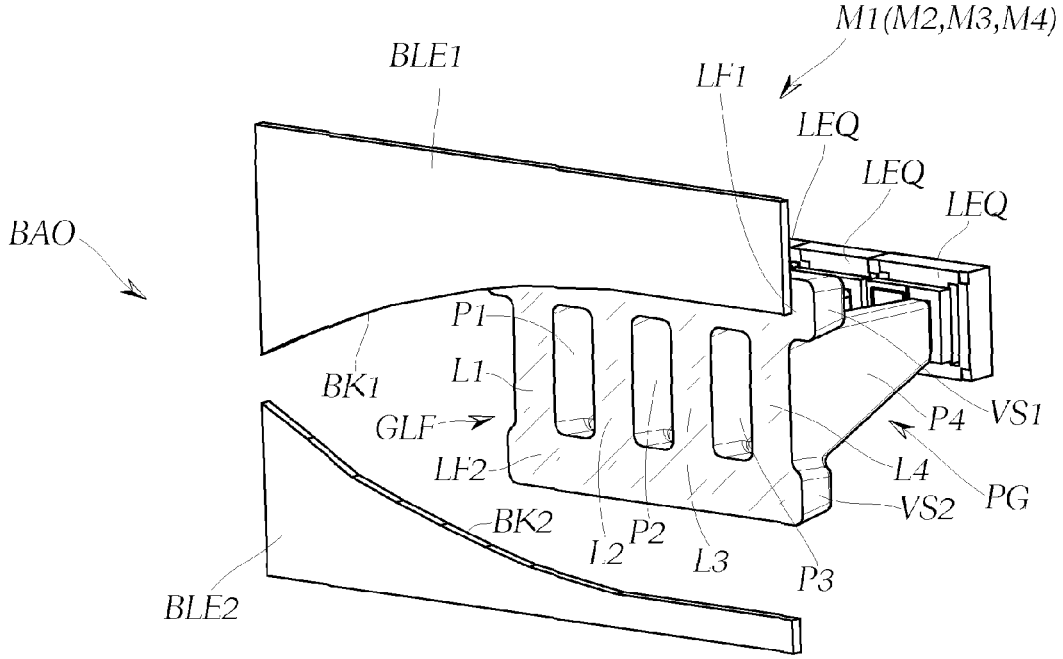
FIG. 2 shows an enlarged illustration of a single LED light source module of FIG. 1.
Figure 10:
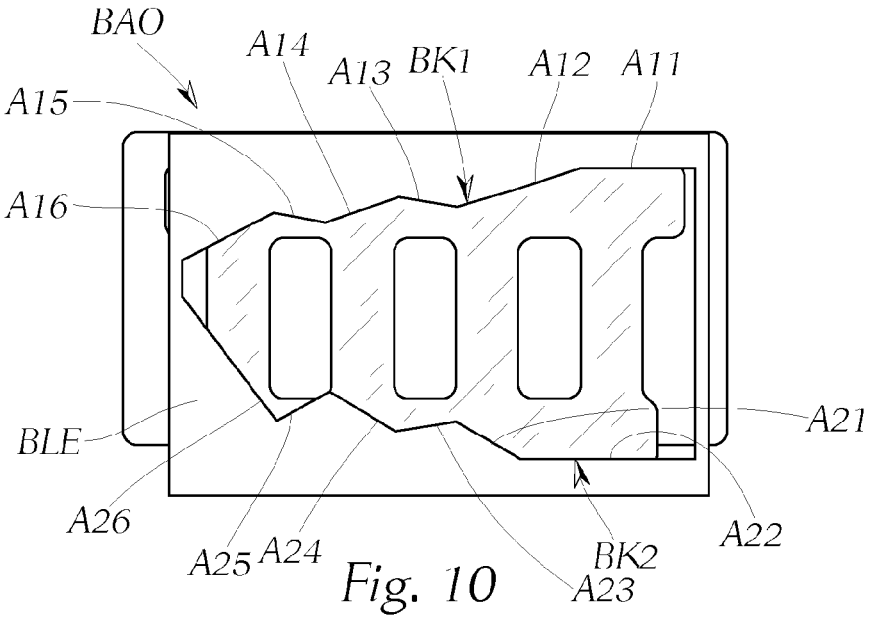
FIG. 10 shows a front view of the module of FIG. 9.

FIG. 2 shows such an LED light source module M1 (M2, M3, M4) without the secondary lens in a detailed illustration. The LED light source module M1 comprises a plurality of LED light sources LEQ, here specifically four such LED light sources, which in turn are each composed of at least one light-emitting diode. The individual light-emitting diodes are not visible in FIG. 2; FIG. 10, for example, shows LED light sources LEQ, each having exactly two light-emitting diodes LED1, LED2.

Figure 4:
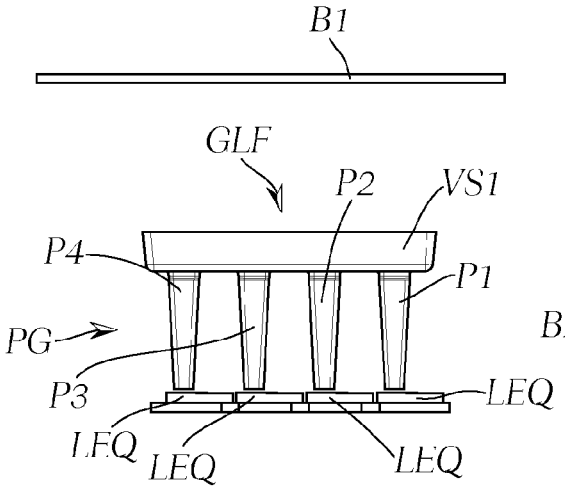
FIG. 4 shows a top view onto the module of FIG. 2.
Figure 5:
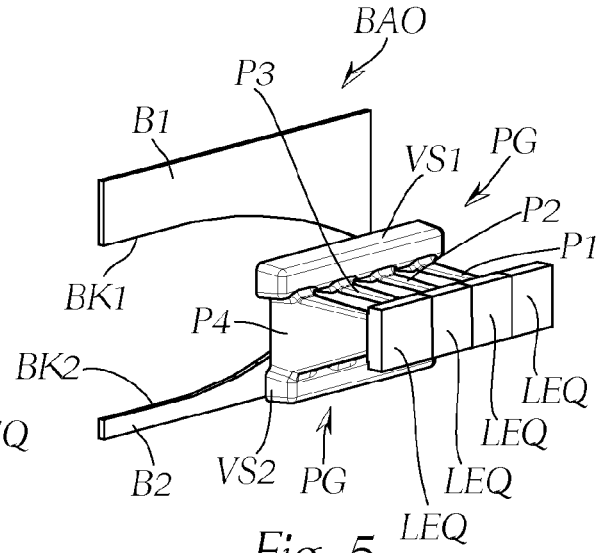
FIG. 5 shows a perspective rear view of the module of FIG. 2.

FIGS. 4 and 5 show the LED light source module of FIG. 2 in a view from above and in a perspective view obliquely from behind.

Each LED light source LEQ couples light into an associated primary lens element P1 to P4, which exits again via the respective light exit area L1 to L4 of the primary lens element P1 to P4. These light exit area segments L1 to L4 are imaged as light segments in the light pattern, the superimposition of the segments of the individual modules M1 to M4 of the (left) headlight and of those of the right headlight then resulting in the total light distribution.

The light exit areas L1 to L4 form the total light exit area GLF, wherein in this variant of the invention advantageously the primary lens elements P1 to P4 are joined to a joining rib VS1 in an upper region and preferably also to such a rib VS2 in a lower region. Light from the LED light sources LEQ can likewise enter these ribs VS1, VS2 and then exits again via the light exit areas LF1, LF2 of the ribs VS1, VS2 and contributes to the light distribution, homogenizing the same.

The light exit areas LF1, LF2 of the two ribs are thus part of the total light exit area GLF, and the primary lens elements P1 to P4 and the two ribs VS1, VS2, which are preferably designed as one piece and of the same material, form what is referred to as the primary lens.

According to the invention, a diaphragm assembly BAO, which in the example shown comprises two optically effective diaphragm edges BK1, BK2, is provided between the (total) light exit area GLF of the primary lens PG and the secondary lens, the effective diaphragm edges being arranged and/or extending in such a way that undesirable distortions occurring in an upper and/or lower region of the light pattern are at least partially suppressed in the light pattern.

In the schematic variant according to FIG. 2, the two diaphragm edges BK1, BK2 are designed as edges of two planar diaphragms BLE1, BLE2.

The diaphragm edges BK1, BK2, or the projection thereof into a vertical plane, have/has a curved course, for example. A diaphragm edge is thus composed of one or more curved curve sections in a projection into the vertical plane.

Figure 3:
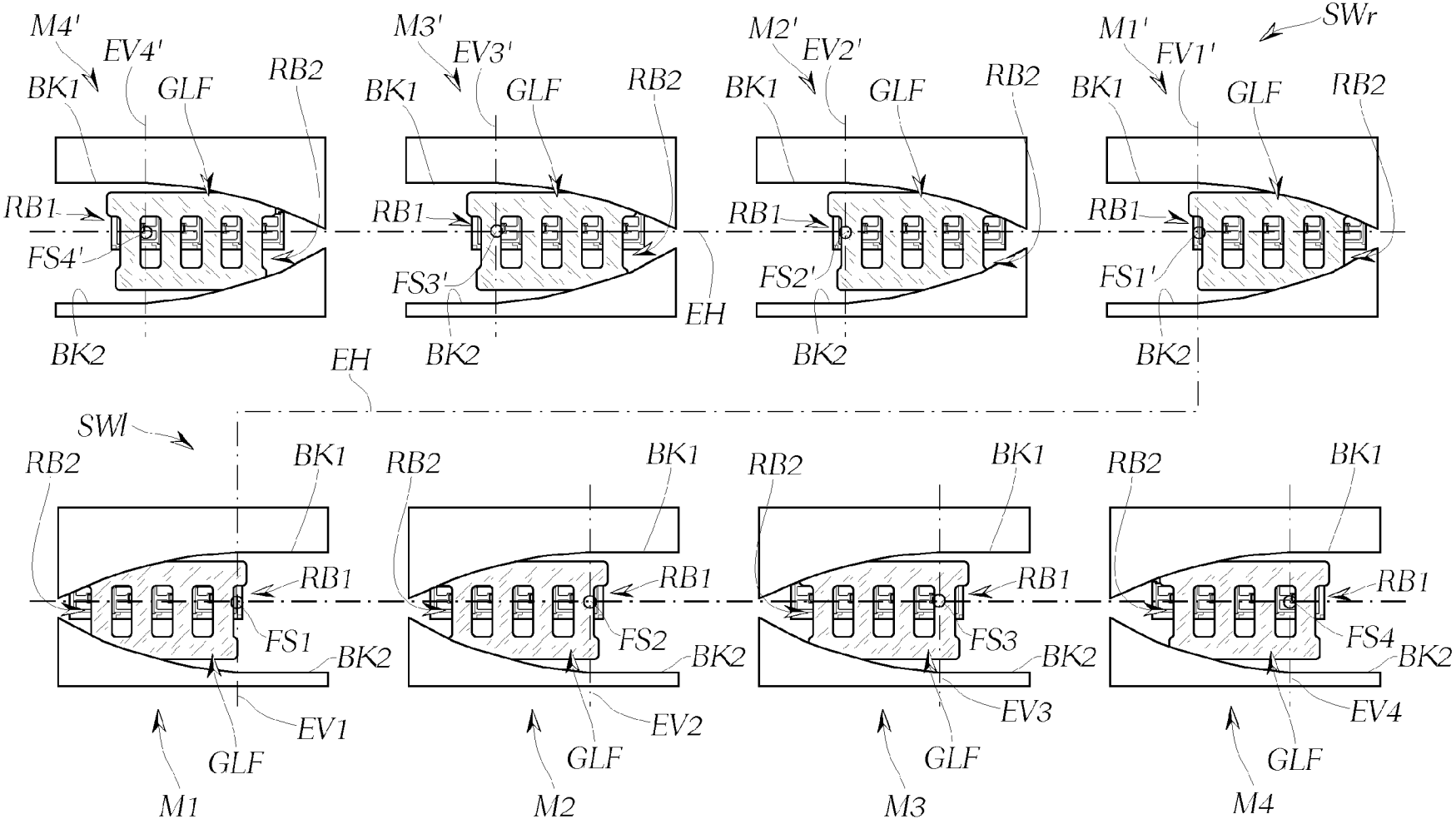
FIG. 3 shows a schematic comparison of a left headlight (bottom) and a right headlight (top) and the laterally reversed arrangement.

FIG. 3 schematically shows a vehicle headlight system, composed of a right headlight SWr, which is shown at the top of FIG. 3, and a left headlight SWl, which is shown at the bottom. In reality, these two headlights are of course arranged on the left and right, preferably in the corner regions of the front of a vehicle, and not on top of each other as is shown.

In the variant shown, the modules M1 to M4 (M1' to M4') of a headlight have a virtually identical design, which is to say identical primary lenses PG and identical diaphragm assemblies, which is to say identical diaphragm edges BK1, BK2, are used.

The difference between the individual modules M1 to M4 (M1' to M4') consists in the position of the diaphragm edges BK1, BK2 in relation to the light exit areas GLF of the primary lenses PG, as will be described in more detail hereafter.

In principle, the secondary lenses are generally also identical, but differ within a headlight and between the headlights by a different design allowance.

The total light exit area GLF of the primary lenses PG, formed of the light exit areas L1 to L4 of the primary lens elements P1 to P4 and the light exit areas LF1, LF2 of the joining ribs VF1, VS2, has a defined height and width, for example in the form of a rectangle. The total light exit area GLF is then this rectangle, minus those regions in which no light exit area is located, which is to say in particular those regions between the primary lens elements and laterally next to the two outer primary lens elements.

When looking at the left headlight SWl (these deliberations apply analogously to the right headlight SWr), it can be seen that the focal points FS1, FS2, FS3, FS4 (right headlight SWr: FS1- to FS4') of the secondary lens elements (not shown) are located in a lateral border region RB1 of the total light exit area GLF. The edges BK1, BK2 have a course/contour at which the edges BK1, BK2 have a larger normal distance to the focal point FS1, FS2, FS3, FS4 (which is to say to a horizontal plane EH through the focal point in the focal point) than to the horizontal plane EH through the focal point in a border region RB2 of the total light exit area GLF located opposite the border region RB1 in which the focal points FS1, FS2, FS3, FS4 is located.

The diaphragm edge thus has a smaller (normal) distance to this horizontal plane in the border region RB2 located further away from the focal point than in the region RB1 of the focal point. However, as is apparent from FIG. 3, the focal point is located at different sites for different modules M1 to M4, but always in the border region RB1.

The focal point of a secondary lens is located in the (vertical) plane of the light exit areas of the primary lens where the optical axis of the secondary lens "penetrates" the plane.

The normal distance of the diaphragm edge BK1, BK2 to the focal point FS1, FS2, FS3, FS4 of the secondary lens elements S1 to S4 constitutes the largest distance of the diaphragm edge BK1, BK2 to the horizontal plane EH. The normal distance to the horizontal plane EH decreases again toward the border region RB2 located further away from the focal point FS1, FS2, FS3, FS4.

The measures described above ensure that light is accordingly blocked in the regions from which the distortions stem, while light from the regions having lower or no distortion is blocked little or not all in the light pattern.

As is further apparent, it is advantageous when the normal distance of the diaphragm edges BK1, BK2 to the focal points FS1, FS2, FS3, FS4 constitutes the largest distance of the respective diaphragm edge BK1, BK2 to the horizontal plane EH, and that preferably the normal distance to the horizontal plane EH then remains the same beyond the border region RB1 which includes the focal point FS1, FS2, FS3, FS4.

The courses of the diaphragm edges BK1, BK2 can be "independent" of each other, however the diaphragm edges of a module can also have a course that is mirrored relative to a horizontal plane of symmetry (which is located beneath the plane EH), as is shown in FIG. 3. This means that the upper edge mirrored about the plane of symmetry yields the lower edge.

In the example shown, in which a high-beam light and/or a partial high-beam light is generated, the horizontal plane through the focal point of the secondary lens is located above this horizontal plane of symmetry through the total light exit area (see above)

On a headlight for low-beam light, the plane EH is located in the plane of symmetry of the primary lenses.

In the example shown, the upper edge BK1 thus has a smaller normal distance, preferably along the entire horizontal extension, to a horizontal plane EH through the focal point FS1, FS2, FS3, FS4 of the secondary lens element S1 to S4 than the lower edge BK2 (each in relation to a defined point along the horizontal plane).

So as to generate a desired light pattern (high-beam light, partial high-beam light), the horizontal plane through the focal point of the secondary lens is located above this plane of symmetry, which is why the different distances of the two diaphragm edges to the horizontal plane through the focal point of the secondary lens occur.

The light pattern is trimmed accordingly less in the lower region than in the upper region (the lower region results from the projection of the upper region of the light exit area by way of the secondary lens and vice versa).

In principle, it applies that the upper and lower edges can have any arbitrary shape, in particularly any arbitrarily mutually deviating shapes, with respect to the particular course, which is to say, any symmetries between the upper and lower edges are not absolutely necessary.

The secondary lens elements of the LED light source modules M1, M2, M3, M4; M1, M2', MY, M4' and the arrangement of the light exit areas GLF of the primary lenses PG are matched to each other in such a way that the light segments from the individual LED light source modules M1, M2, M3, M4; M1, M2', M4', M4' are imaged offset from each other in the horizontal direction. The individual LED light sources can be operated separately.

The LED light source modules M1 to M4; M1' to M4' of a headlight are arranged in a horizontal row in each case, so that the individual segments of the primary lenses are located next to each other and are imaged in an overlapping manner so as to form the desired light distribution in front of the vehicle.

The focal points FS1 to FS4, FS1' to FS4' of the secondary lens elements of the LED light source modules are located in a common vertical plane, which is spanned by the total light exit areas GLF of the primary lenses PG of the LED light source modules, and in a common horizontal plane EH.

The focal points FS1 to FS4, FS1' to FS4' of the secondary lenses of the individual LED light source modules are arranged mutually offset from each other laterally, which is to say in the horizontal direction, in relation to the respective total light exit area GLF of the primary lenses PG.

In this way, optimal overlapping of the individual segments of the individual primary lens elements is achieved.

Specifically, it is provided that the focal points FS1 to FS4, FS1 to FS4' of the secondary lens elements are each located in a lateral border region RB1 of the total light exit area GLF of the respective associated primary lenses PG, wherein, in a first outer LED light source module M1, M1' (the vehicle-internal module), the focal point FS1, FS1' is located closest to the border of the total light exit area GLF, and the focal point FS2 to FS4, FS2' to FS4' moves away from the border upon progressing in the direction of the opposing outer LED light source module M4, M4' (vehicle-external) of the headlight.

The focal points thus move away from the one border, but only far enough for them to continue to remain in the "border region" RB1. This means that the two outer focal points (FIG. 3: FS1, FS4 or FS1', FS4') are located away from each approximately in the range of the width of a segment, which is to say the width of the light exit area of a primary lens element.

The shift of the individual focal points in relation to the border depends on the width of the segments (width of the light exit areas of the primary lens elements) and is selected so that a designed homogeneity and resolution of the light distribution are obtained. For example, it is provided in the shown variant that the distance of focal point FS1 to FS3 (if the four modules were, in theory, placed on top of each other) is equally as large as the width of the light exit area of the supplementary lens. It is thus ensured that module M1 and module M3 result in full light distribution (which is to say module M3 illuminates the gaps of module M1). The focal points of FS2 and FS4 likewise have the same distance to each other and likewise result in full light distribution. However, the distance between FS1 and FS2, or FS3 and FS4 is not a full, but only half a segment width. Due to these superimpositions, a better resolution is obtained, and the homogeneity of the (high-beam) light likewise improves.

It is thus provided that the focal point FS1, FS1' comes closest to the border of the total light exit area GLF of the primary lens PG in the vehicle-internal LED light source module M1, M1', and the focal point FS4, FS4' is located the farthest from the border of the total light exit area GLF of the associated primary lens PG in the vehicle-external LED light source module M4, M4'.

As can be seen, the diaphragm is, or the diaphragm edges are, arranged in a fixed manner in relation to the focal point of the secondary lens, which is to say the diaphragm can be fixedly position relative to the projection lens (secondary lens) on one specific embodiment.

The primary lenses are thus horizontally laterally shifted relative to the projection lenses and diaphragms. Together with the diaphragm, the projection lens can thus preferably form a structural unit, for example, the diaphragm can be attached to the lens holder.

Figure 6:
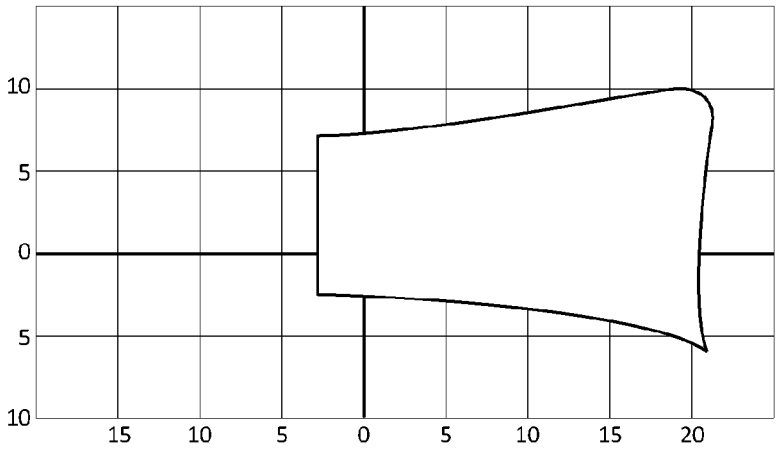
FIG. 6 shows an exemplary light distribution of a single module without the diaphragm assembly according to the invention.

FIG. 6 shows an exemplary schematic light distribution generated by a single LED light source module without the diaphragm assembly according to the invention. As can be seen, the light pattern becomes increasingly distorted as the distance from the vertical 0° line increases.

Figure 7:
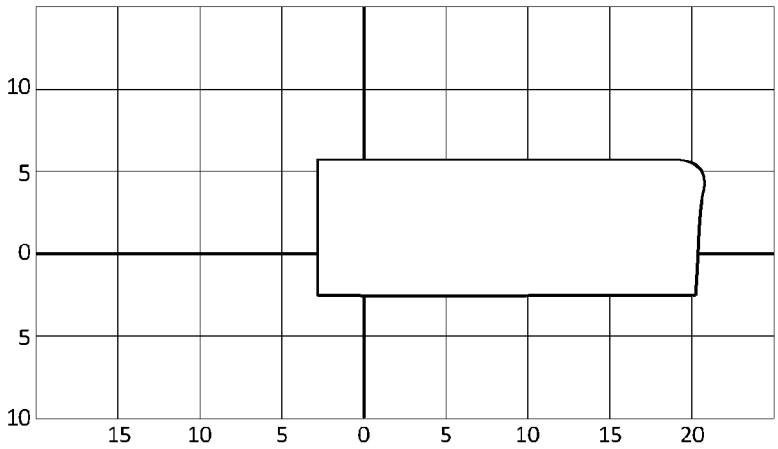
FIG. 7 shows an exemplary light distribution of a single module when using a diaphragm assembly according to the invention.

FIG. 7 shows an exemplary schematic light distribution of a module as that which is used in FIG. 6, however now with an interposed diaphragm assembly according to the invention. As can be seen easily in the figure, the light pattern here no longer has any noteworthy distortions.

Analogously to FIG. 1, FIG. 8 again shows a vehicle headlight comprising four LED light source modules M1 to M4 in a row. The diaphragm assembly BAO here comprises two optically effective diaphragm edges BK1, BK2, which are configured in a single diaphragm BLE—for details refer also to FIG. 9.

As can be seen easily from FIG. 10, the diaphragm edges BK1, BK2, or the projections of the two diaphragm edges BK1, BK2 into a vertical plane, are composed of a plurality of rectilinear sections A11, A12, A13, A14, A15, A16, A21, A22, A23, A24, A25, A26. The transition between two rectilinear sections takes place discontinuously, for example, such as in the form of an edge.

Figure 8:
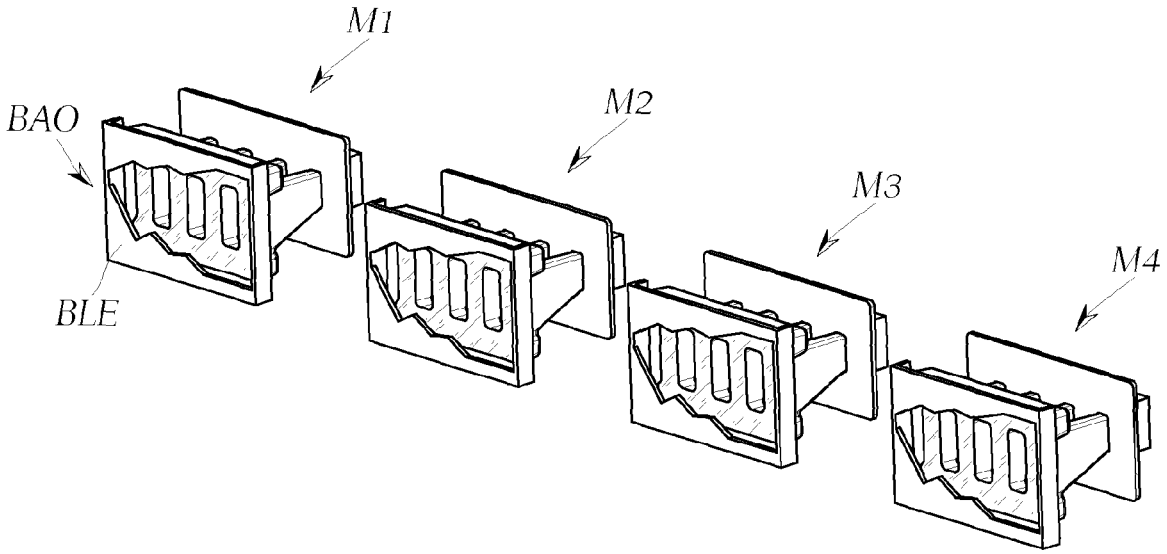
FIG. 8 shows a perspective view of a further headlight comprising multiple (four) LED light source modules for generating a light pattern.
Figure 9:
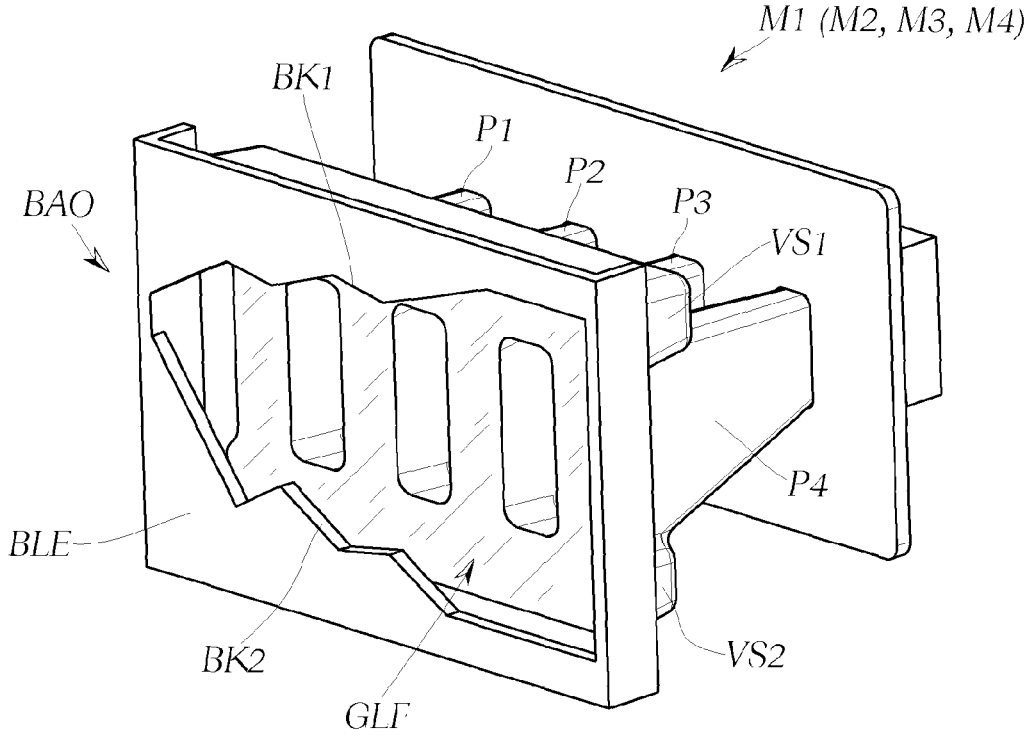
FIG. 9 shows an enlarged illustration of a single LED light source module of FIG. 8.
Figure 11:
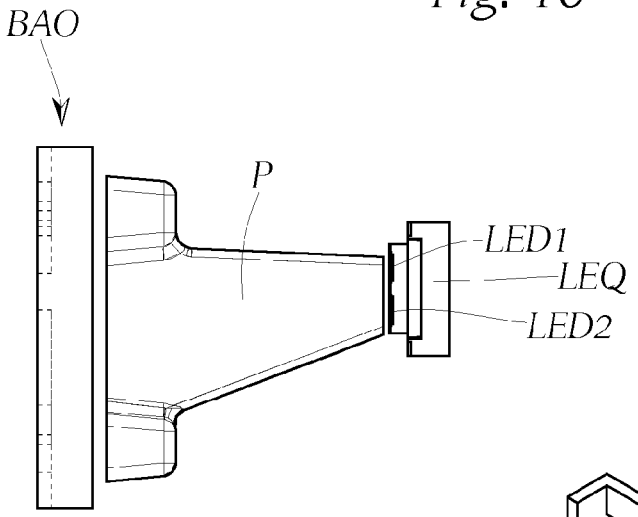
FIG. 11 shows a side view of the module of FIG. 9.
Figure 12:
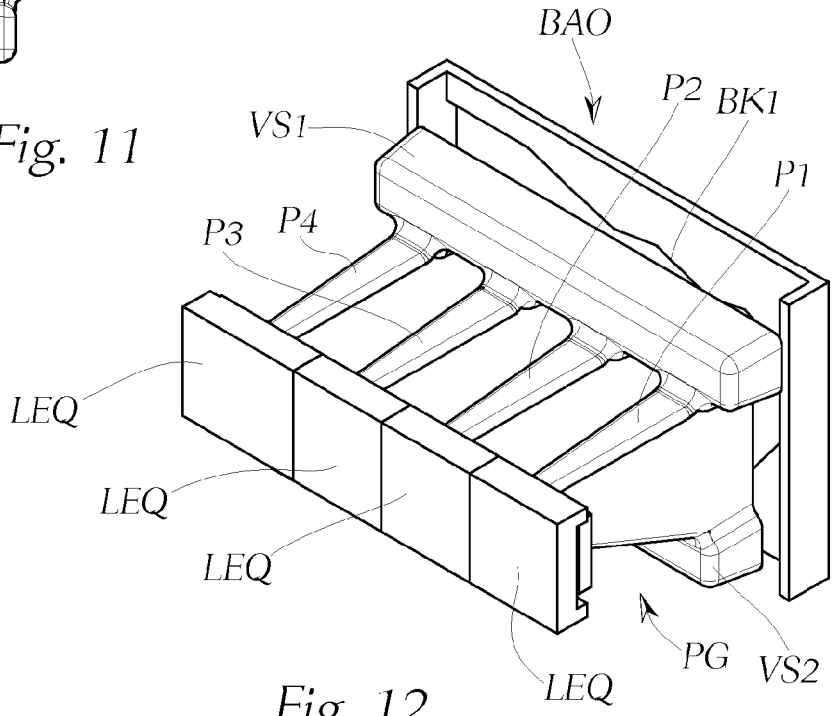
FIG. 12 shows a perspective rear view of the module of FIG. 9.

FIGS. 11 and 12 show the module of FIG. 8 in a view from the side and obliquely from behind.

Figure 13:
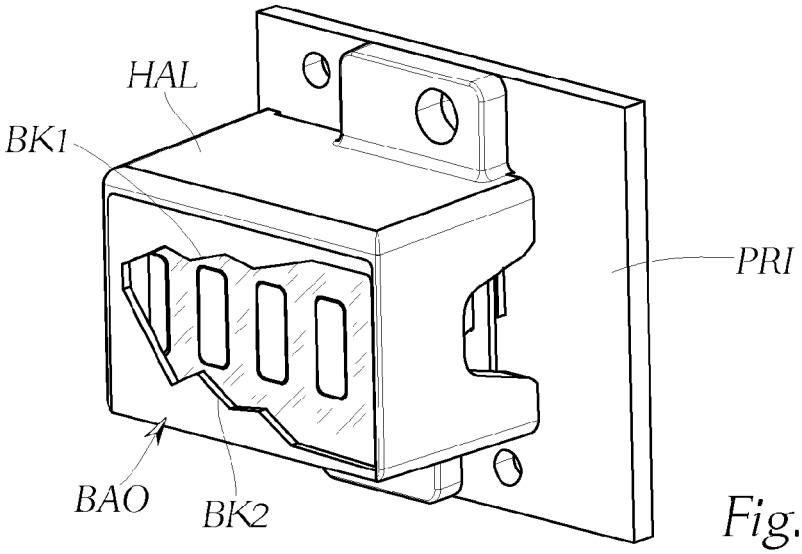
FIG. 13 shows a perspective view of a light source module, in which the diaphragm assembly is joined or designed as one piece with the supplementary lens holder (primary lens holder)
Figure 14:
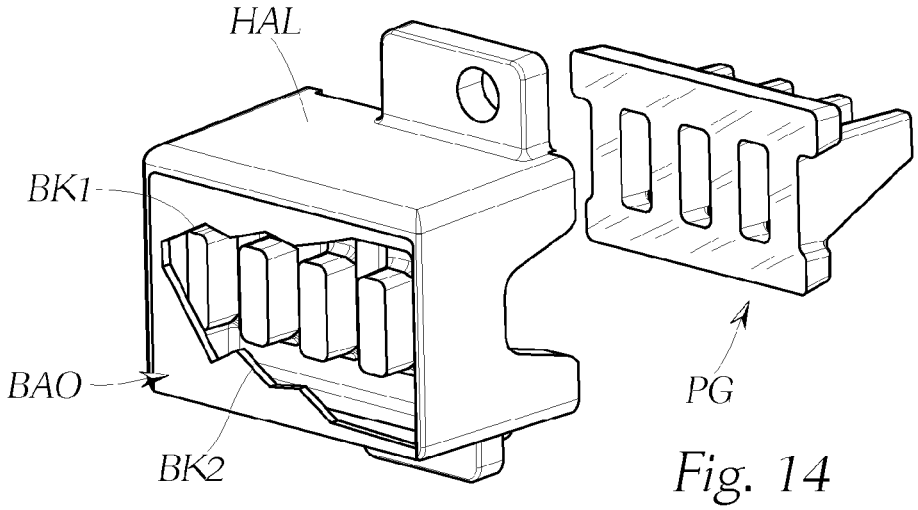
FIG. 14 shows an exploded view of the module of FIG. 13.

FIGS. 13 and 14 show an LED light source module comprising a diaphragm assembly BAO as in FIG. 8, with the difference being that the diaphragm assembly BAO is designed as one piece with a holder HAL for the primary lens PG. In other words, the diaphragm edges BK1, BK2 are formed in the holder HAL for the primary lens PG. In principle—not only when the diaphragm edges are formed in the holder—the holder HAL is made of a non-translucent material, otherwise light could propagate in the holder, whereby the optical function—including failure to function—would be impaired. The holder is used to attach the primary lens PG to the LED print PRI.

In each of the above-described embodiments, which require little space and optically supply very good results, it is provided that the diaphragm has a planar design, or that the diaphragm edges BK1, BK2 are located in a vertical plane, which preferably runs parallel to the total light exit area PG of the primary lens element. The diaphragm has a planar design and is situated normal to the light exit direction in the beam path.

Figure 15:
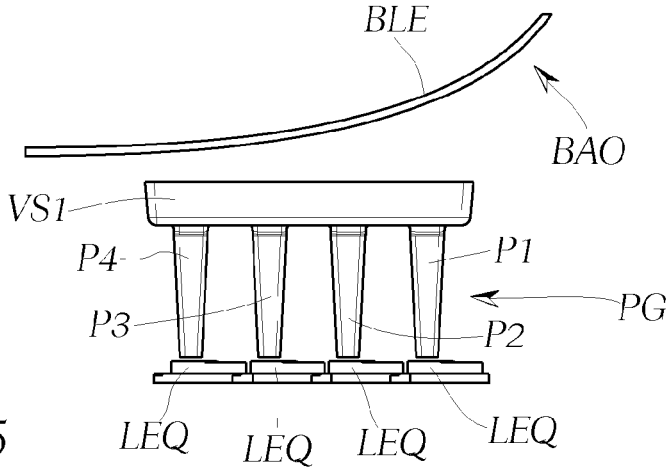
FIG. 15 shows a top view onto a light source module having a curved diaphragm.

FIG. 15 shows a further variant in a view from above, in which the diaphragm BLE (and thus the one or both diaphragm edges) is cured in the horizontal direction, wherein the curvature preferably corresponds essentially to the field of curvature of the secondary lens element or follows this field of curvature. The diaphragm BLE is curved away from the light exit area of the primary lens element.

The curvature of the at least one diaphragm edge (in a horizontal plane) follows the field of curvature of the secondary lens.

The invention claimed is:

1. An LED light source module for an LED motor vehicle headlight for generating a dynamic light distribution, the LED light source module comprising:

one or more LED light sources, the one or more LED light sources being composed of one or more light-emitting diodes, and the one or more light-emitting diodes coupling light into an associated primary lens of one or more primary lenses, the in-coupled light at least partially exiting one or more light exit areas of the one or more primary lenses, at least one secondary lens, which images the light exiting the one or more light exit areas of the one or more primary lenses, when the headlight is installed in a vehicle, as a light pattern onto a region located in front of the vehicle, a diaphragm assembly between the one or more light exit areas of the one or more primary lenses and the at least one secondary lens, the diaphragm assembly comprising at least one diaphragm edge, wherein a total light exit area, formed of the one or more light areas of the one or more primary lenses has a defined height and width, wherein:

a focal point of the at least one secondary lens is located in a lateral border region of the total light exit area, the at least one diaphragm edge has a course/contour at which the at least one diaphragm edge has a larger distance to the focal point along a normal distance to a horizontal plane through the focal point of the at least one secondary lens than to the horizontal plane in a border region of the total light exit area located opposite the focal point, and the normal distance of the diaphragm edge to the focal point of the at least one secondary lens constitutes the largest distance of the at least one diaphragm edge to the horizontal plane, and the normal distance to the horizontal plane decreases toward the border region located further away from the focal point, so that undesired distortions occurring in an upper and/or lower region of the light pattern are at least partially suppressed in the light pattern.

2. The LED light source module according to claim 1, wherein the one or more LED light sources comprises two or more LED light sources.

3. The LED light source module according to claim 1, wherein the normal distance of the diaphragm edge to the focal point of the at least one secondary lens constitutes the largest distance of the diaphragm edge to the horizontal plane, and the normal distance to the horizontal plane remains the same as the normal distance of the diaphragm edge to the focal point.

4. The LED light source module according to claim 1, wherein the at least one diaphragm edge comprises two optically effective diaphragm edges, these being an upper diaphragm edge and a lower diaphragm edge.

5. The LED light source module according to claim 4, wherein the diaphragm assembly is composed of one diaphragm or two diaphragms, which comprise the at least one diaphragm edge.

6. The LED light source module according to claim 1, wherein the diaphragm assembly is designed as one piece with, or is attached to, a holder for the one or more primary lenses.

7. The LED light source module according to claim 1, wherein the diaphragm assembly is formed of a material that is at least partially optically transparent.

8. The LED light source module according to claim 7, wherein the diaphragm assembly or at least one diaphragm thereof is coated with a semi-transparent material.

9. The LED light source module according to claim 1, wherein the diaphragm assembly comprises at least one diaphragm having a planar design or that the at least one diaphragm edge is located in a vertical plane, which runs parallel to the total light exit area of the one or more primary lenses.

10. The LED light source module according to claim 1, wherein at least one diaphragm of the diaphragm assembly, or the at least one diaphragm edge, is curved in a horizontal direction, wherein the curvature follows or corresponds essentially to a field of curvature of the at least one secondary lens.

11. The LED light source module according to claim 1, wherein the at least one diaphragm edge, or a projection of the at least one diaphragm edge into a vertical plane, has a curved course.

12. The LED light source module according to claim 1, wherein the at least one diaphragm edge, or a projection of the at least one diaphragm edge into a vertical plane, is composed of one or more rectilinear section(s).

13. The LED light source module according to claim 11, wherein a transition between two curved curve sections is discontinuous.

14. The LED light source module according to claim 1, wherein the at least one diaphragm edge, or a projection of the at least one diaphragm edge, has a continuous or a discontinuous course.

15. The LED light source module according to claim 1, wherein exactly two diaphragm edges are provided, wherein an upper edge has a normal distance to a horizontal plane through the focal point of the at least one secondary lens that is smaller than that of a lower edge.

16. The LED light source module according to claim 1, wherein exactly two diaphragm edges are provided, wherein an upper edge and a lower edge have courses that are mirrored with respect to a horizontal plane of symmetry.

17. The LED light source module according to claim 1, wherein the one or more light exit areas of the one or more primary lenses are joined to each other by way of a translucent material in such a way that light that is coupled into the one or more primary lenses can enter the translucent material and exit the same again via a light exit area of the translucent material.

18. The LED light source module according to claim 17, wherein the one or more light exit areas of the one or more primary lenses are located in a common area, and the light exit area of the translucent material is likewise located in the common area of the one or more light exit areas of the one or more primary lenses.

19. The LED light source module according to claim 17, wherein the one or more light exit areas of the one or more primary lenses are joined to each other in an upper and/or in a lower region.

20. The LED light source module according to claim 17, wherein at least one essentially horizontal joining rib, which is formed of the translucent material, is provided, which joins the one or more primary lenses to each other in an upper and/or lower regions of the one or more light exit areas thereof.

21. The LED light source module according to claim 20, wherein two essentially horizontal joining ribs which are formed of the translucent material, are provided, which join the one or more primary lenses to each other in the upper and lower regions of the one or more light exit areas thereof.

22. The LED light source module according to claim 20, wherein the at least one joining rib is designed as one piece with the one or more light exit areas of the one or more primary lenses or with the one or more primary lenses.

23. The LED light source module according to claim 20, wherein the one or more light exit areas of the one or more primary lenses and those of the at least one joining rib form a common light exit area.

24. The LED light source module according to claim 17, wherein the one or more light exit areas of the one or more primary lens are rectangular.

25. The LED light source module according to claim 17, wherein the one or more light exit areas have an identical shape.

26. The LED light source module according to claim 17, wherein the one or more light exit areas of the one or more primary lenses are arranged parallel to each other and in identical orientation.

27. The LED light source module according to claim 17, wherein the one or more light exit areas of the one or more primary lens are arranged next to each other at a horizontal distance.

28. The LED light source module according to claim 17, wherein the one or more light exit areas are designed standing in a vertical direction, having a larger height than width.

29. The LED light source module according to claim 17, wherein neighboring light exit areas of the one or more light exit areas have a normal distance to each other which corresponds to a width of a light exit area.

30. The LED light source module according to claim 17, wherein a distances between the one or more light exit areas are identical in the case of three or more primary lenses.

31. The LED motor vehicle headlight for generating a dynamic light distribution, comprising two or more LED light source modules according to claim 1.

32. The headlight according to claim 31, wherein the at least one secondary lens and an arrangement of the one or more light exit areas are matched to each other in such a way that light segments from the individual LED light source modules generated by the one or more light exit areas are imaged offset from each other in a horizontal direction, wherein the one or more LED light sources can be operated separately.

33. The headlight according to claim 31, wherein a course of the at least one diaphragm edge in all LED light source modules is identical.

34. The headlight according to claim 31, wherein the at least one diaphragm edge is arranged differently in relation to the total light exit areas in the different LED light source modules.

35. The headlight according to claim 31, wherein the LED light source modules are arranged in a horizontal row.

36. The headlight according to claim 35, wherein the focal points of the at least one secondary lens of each LED light source module is located in a common vertical plane, which is spanned by the total light exit areas of the one or more primary lenses, and in a common horizontal plane.

37. The headlight according to claim 36, wherein the focal points of the at least one secondary lenses of each LED light source module is arranged mutually offset from each other laterally in relation to the respective total light exit area of the one or more primary lenses.

38. The headlight according to claim 37, wherein the focal points of the at least one secondary lens of each LED light source module is located in a lateral border region of the total light exit area of the respective associated one or more primary lens, wherein, in a first outer LED light source module, the focal point is located closest to a border of the total light exit area, and the focal point moves away from the border upon progressing in the direction of the second outer LED light source module.

39. The headlight according to claim 38, wherein the focal point comes closest to the border of the total light exit area of the one or more primary lenses in a vehicle-internal LED light source module, and the focal point is located the farthest from the border of the total light exit area of the associated one or more primary lenses in a vehicle-external LED light source module.

40. The headlight according to claim 31, wherein the individual LED light source modules comprise identical at least one secondary lenses.

41. The headlight according to claim 31, wherein all distances between the one or more light exit areas of neighboring LED light sources over the entire headlight are identical.

42. The headlight according to claim 31, wherein a total arrangement of the one or more light exit areas of an LED light source module in relation to an optical axis of the at least one secondary lens assumes a defined position in a horizontal direction, wherein a different total arrangements of the individual LED light source modules have defined positions that differ from each other in the horizontal direction in relation to the optical axis of the respective associated at least one secondary lens.

43. The headlight according to claim 31, wherein a first total arrangement of the one or more light exit areas assumes a first defined position in relation to an optical axis of the at least one secondary lens, wherein a second/third/fourth . . . n-th total arrangement is displaced in relation to the optical axis of the at least one secondary lens as compared to the first total arrangement by half/once/twice/quadruple/((n−1)/2) times a normal distance between two neighboring light exit areas of an LED light source module.

44. The headlight according to claim 31, wherein the one or more light exit areas of all LED light source modules of the headlight in each case are arranged on one side of a vertical plane through an optical axis of the respective associated at least one secondary lens.

45. The headlight according to claim 31, wherein each light-emitting diode of an LED light source can be operated separately.

46. The vehicle headlight system comprising two headlights according to claim 31, wherein a left headlight, when installed in the vehicle, generates the left portion of the light distribution on the roadway and a right headlight generates a right portion of the light distribution.

47. The vehicle headlight according to claim 46, wherein at least each LED light source of the two headlights can be separately operated.

48. The vehicle headlight according to claim 46, wherein the left and right headlights have a laterally reversed design with respect to the arrangement of the focal points of the at least one secondary lenses in relation to the associated one or more primary lenses and with respect to the courses of the at least one diaphragm edges.

49. The LED light source module of claim 1, wherein the total light exit area is in the form of a rectangle.

50. The LED light source module of claim 3, wherein the normal distance to the horizontal plane beyond the border region that includes the focal point remains the same as the normal distance of the at least one diaphragm edge to the focal point.

51. The LED light source module of claim 12, wherein the transition between two of the rectilinear sections is discontinuous.

52. The headlight of claim 33, wherein having two diaphragm edges per LED light source module, the two diaphragm edges being an upper diaphragm edge and a lower diaphragm edge, wherein the upper diaphragm edges have an identical course and/or the lower diaphragm edges have an identical course.

* * * * *